US008735760B2

(12) United States Patent
Jin

(10) Patent No.: US 8,735,760 B2
(45) Date of Patent: May 27, 2014

(54) GAS INSULATED SWITCHGEAR

(75) Inventor: Sang Yong Jin, Chungcheongbuk-Do (KR)

(73) Assignee: LS Industrial Systems Co., Ltd., Anyang-Si, Gyeonggi-Do (KR)

( * ) Notice: Subject to any disclaimer, the term of this patent is extended or adjusted under 35 U.S.C. 154(b) by 321 days.

(21) Appl. No.: 13/006,336

(22) Filed: Jan. 13, 2011

(65) Prior Publication Data

US 2011/0180514 A1 Jul. 28, 2011

(30) Foreign Application Priority Data

Jan. 26, 2010 (KR) ..... 10-2010-0007151

(51) Int. Cl.
*H01H 33/56* (2006.01)
*H01H 33/02* (2006.01)

(52) U.S. Cl.
USPC ..... 218/155; 218/13; 218/43

(58) Field of Classification Search
USPC ..... 218/146, 7, 13–15, 43, 46, 51, 68, 76, 218/78–81, 84, 85, 149, 153–157
See application file for complete search history.

(56) References Cited

U.S. PATENT DOCUMENTS 4,161,621 A * 7/1979 Bolin et al. ..... 174/14 R
6,307,172 B1 * 10/2001 Bolin et al. ..... 218/155
6,583,375 B2 * 6/2003 Mahl et al. ..... 218/43
6,680,453 B2 * 1/2004 Rokunohe et al. ..... 218/2
7,211,761 B2 * 5/2007 Vaghini et al. ..... 218/7
7,323,652 B2 * 1/2008 Yoshida et al. ..... 218/78
2007/0080144 A1 * 4/2007 Meyer et al. ..... 218/97

FOREIGN PATENT DOCUMENTS

CN 1245990 3/2000
CN 1862742 11/2006
JP 10234113 9/1998

OTHER PUBLICATIONS

The State Intellectual Property Office of the People's Republic of China Application Serial No. 201110031985.0, Office Action dated May 10, 2013, 6 pages.

* cited by examiner

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

A gas insulated switchgear includes stationary contacts, movable contacts contactable with or uncontactable from the stationary contacts, an insulation case housing the stationary contacts and the movable contacts so as to support the same, the insulation case having a shape of a pipe, flanges disposed at an inner circumferential surface of the insulation case in a circumferential direction, each of the flanges having an annular shape, and a collection groove portion formed at the flanges and collecting metal particles generated during contact or separation operation between the stationary contactors and the movable contactors. Under this configuration, the metal particles can be collected and laid in the collection groove portion provided at the flanges, accordingly, the metal particles cannot be stuck on an insulation member or other components of the insulation case, resulting in obviating occurrence of insulation breakdown within the switchgear and improving reliability of a product.

5 Claims, 2 Drawing Sheets

GAS INSULATED SWITCHGEAR

CROSS-REFERENCE TO RELATED APPLICATION

Pursuant to 35 U.S.C. §119(a), this application claims the benefit of earlier filing date and right of priority to Korean Application No. 10-2010-0007151, filed on Jan. 26, 2010, the contents of which is incorporated by reference herein in its entirety.

BACKGROUND OF THE INVENTION

1. Field of the Invention

This invention relates to a gas insulated switchgear, and particularly, to a gas insulated switchgear, capable of obviating degradation of an insulation performance by accumulating metal particles, which are generated due to friction among metal components included in the switchgear, in a predetermined space, during a process of a movable contact being moved to contact with or separated from a stationary contact.

2. Background of the Invention

A gas insulated switchgear or a gas insulated circuit breaker is an electric device, which is installed on an electric line, on which a super high voltage higher than several ten kilovolts to several hundreds kilovolts flows, so as to safely break the line automatically when the line is deliberately switched on or off in a normal usage state or a large current is generated due to a ground fault or electric shortage of the line, thereby protecting power systems or the like. The gas insulated switchgear may disperse (scatter) extinguishing gas (e.g., sulfur hexafluoride (SF6) gas or nitrogen gas), which has been compressed in a compression chamber and has high insulation force, via a nozzle upon a trip operation of the switchgear, thereby extinguishing arc generated between contacts upon the trip operation.

However, during operation of the gas insulated switchgear, the movable contact and the stationary contact are repeatedly contacted or separated each other. During the repetition, metal components included in the gas insulated switchgear are also repeatedly moved within a particular distance for operating those contacts, thereby causing friction due to contact therebetween. Upon the friction being generated between the metal components, fine metal particles are generated therebetween. Such metal particles are accumulated within an inner space of the switchgear, thereby causing a fatal problem in an insulation performance of the switchgear.

The metal particles have bad influences on the insulation performance regardless of size or entire amount thereof. Hence, it is ideal to substantially obviate the generation of the metal particles. However, the metal particles are inevitably generated at a conductive unit made of a metal. Consequently, a configuration, in which the metal particles generated in response to the repetition of the switchgear are not allowed to affect the insulation performance, is required.

SUMMARY OF THE INVENTION

Therefore, to address the problems of the related art, an aspect of this invention is to provide a mechanism for accumulating metal particles, which are generated within a gas insulated switchgear, within a certain space, so as to obviate the metal particles from affecting an insulation performance of the gas insulated switchgear.

Another aspect of this invention is to minimize (prevent) scattering (dispersing) of metal particles, by formation of an accumulation space, which is formed in an insulation case, which houses inner metal components of the gas insulated switchgear to support them, so as to collect the metal particles therein.

To achieve these and other advantages and in accordance with the purpose of the detailed description, as embodied and broadly described herein, a gas insulated switchgear may include stationary contacts, movable contacts contactable with or uncontactable from the stationary contacts, an insulation case configured to house the stationary contacts and the movable contacts so as to support the same, the insulation case having a shape of a pipe, flanges disposed at an inner circumferential surface of the insulation case in a circumferential direction, each of the flanges having an annular shape, and a collection groove portion formed at the flanges and configured to collect metal particles generated during contact or separation operation between the stationary contactors and the movable contactors.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the invention and are incorporated in and constitute a part of this invention, illustrate embodiments of the invention and together with the description serve to explain the principles of the invention.

In the drawings.

DETAILED DESCRIPTION OF THE INVENTION

Description will now be given in detail of the exemplary embodiments according to this invention, with reference to the accompanying drawings.

Figure 1:
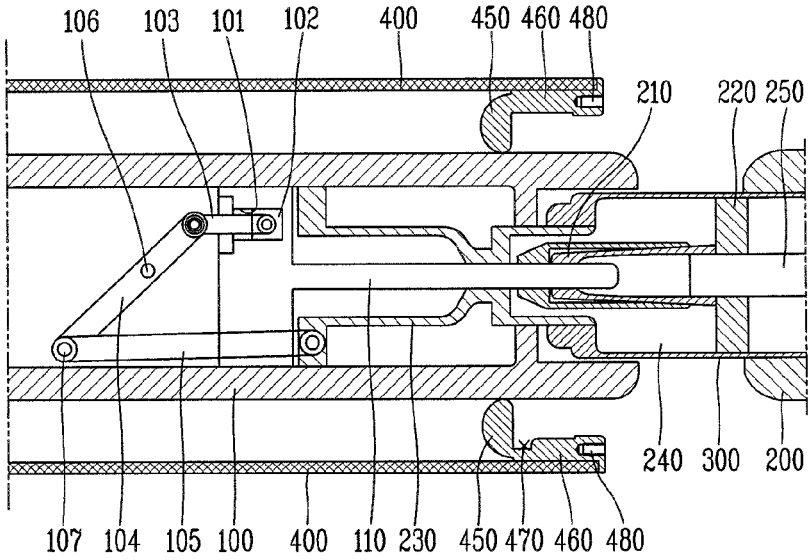
FIG. 1 is vertical sectional view showing a closed state of a gas insulated switchgear in accordance with one exemplary embodiment.
Figure 2:
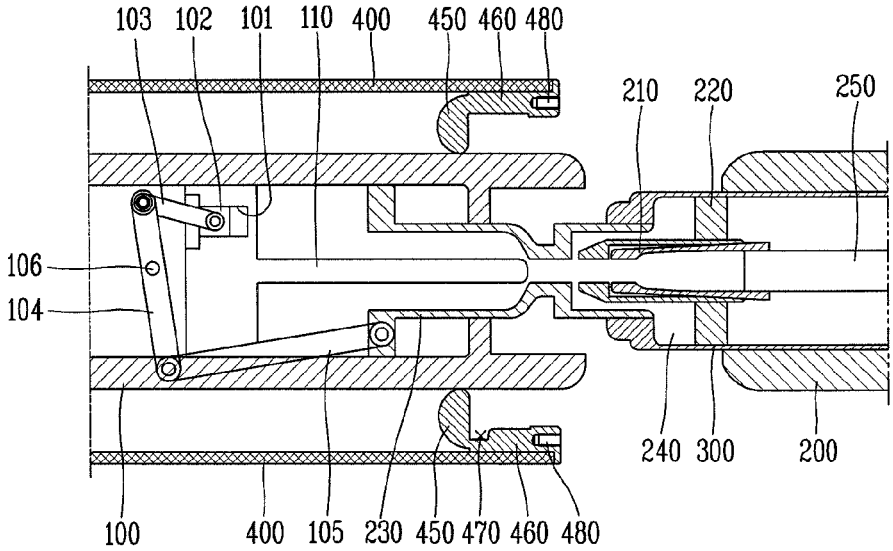
FIG. 2 is a vertical sectional view showing an open state of the gas insulated switchgear of FIG. 1.
Figure 3:
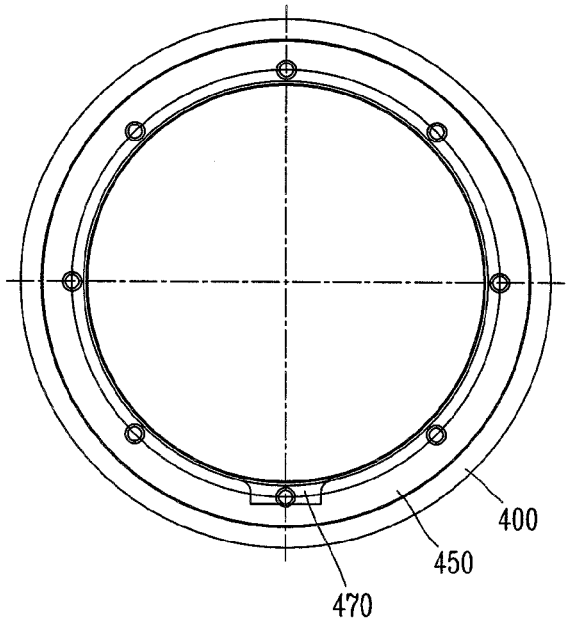
FIG. 3 is a sectional view of an insulation case of the gas insulated switchgear of FIG. 1.

FIGS. 1 and 2 exemplarily show a gas insulated switchgear. FIG. 1 is a sectional view showing a closed state (ON state) of a breaking unit, FIG. 2 is a sectional view showing an open state (breaking or trip position), and FIG. 3 is a vertical sectional view of an insulation case of the gas insulated switchgear. Here, for the sake of explanation, an insulation case 400 for housing a movable contact, a stationary contact and the like, is merely partially illustrated.

As shown in FIG. 1, a breaking unit of the gas insulated switchgear may be divided into a stationary part and a movable part. The stationary part may include a first stationary contact 100 and a first arc contact 110. The movable part may include a second stationary contact 200, a movable contact 300 movably installed within the second stationary contact 200, a stationary piston 220 installed within the movable contact 300 for forming a cylinder 240, a second arc contact 210 contactable with or uncontactable from the first arc contact 110 with moving responsive to the movement of the movable contact 300, a nozzle 230 fixed to the movable contact 300, and a connection rod (not shown) for connecting a rod 250 of the movable contact 300 to a manipulator (not shown) of the switchgear.

A mechanism, which is formed at the front of the nozzle 230 for interlocking the movable part and the stationary part, may include a first link 103 rotatably connected based upon a connecting pin, a second link 104 rotatably connected to the first link 103 by a connecting pin, moving in response to the movement of the first link 103, and rotating based upon a fixed pin 106, and a third link 105 having one end rotatably connected to the second link 104 by a pin and another end connected to a delay unit.

The first arc contact 110 may include a sliding groove portion 101 having a predetermined length, and a sliding mass 102 connected to the first link 103 to be slidable within the sliding groove portion 101 and delaying a driving force from the first link 103 by a time of being moved within the sliding groove portion 101 so as to transfer to the first arc contact 110.

With the configuration of the gas insulated switchgear, in a normal conducting state, as shown in FIG. 1, the movable contact 300 and the second stationary contact 200 are in a contact state, and thus the second arc contact 210 is connected to the first arc contact 110, thereby maintaining a closed state of an electric circuit.

In the above state, when the switchgear is tripped, referring to FIG. 2, a force for pulling the rod 250 in a right direction (i.e., an opening (tripping) direction) is transferred via the connection rod connected to an external actuator, which is not shown, thereby starting a high speed trip operation, and both the movable contact 300 and the second arc contact 210 connected to the rod 250 are moved in a right direction in the drawing.

Here, at the same time when the movable part, namely, the movable contact 300 and the second arc contact 210 are moved in the right direction (i.e., in the tripping direction) in the drawing, the first arc contact 110 is moved opposite (i.e., in the left direction in the drawing) to the moving direction of the movable part by virtue of the plurality of links 103, 104 and 105 connected to the front of the nozzle 230.

That is, when the first link 103 connected to the front of the nozzle 230 is moved in the left direction in the drawing, the second link 104 is accordingly rotated in a counterclockwise direction based upon the fixed pin 106. The third link 105 connected to the second link 104 is cooperatively moved in the right direction in the drawing in response to the rotation of the second link 104. Accordingly, the sliding mass 102 connected to the third link 105 is linearly moved in the left direction in the drawing within the sliding groove portion 101.

FIGS. 1 to 3 show an insulation case 400, which acts as a supporter for housing outer circumferential surfaces of the first stationary contact 100 and the second stationary contact 200 to support the same and simultaneously insulate them. The insulation case 400, which is a type of a pipe whose horizontal sectional surface is circular, is generally made of a fiber reinforced plastic (FRP) material, and has an insulation function. Both ends of the insulation case 400 are shown having flanges 450 and 460 in an annular form, attached onto an inner circumferential surface of the insulation case 400 in a circumferential direction.

The flanges 450 and 460 according to the one exemplary embodiment may include a horizontal flange 460 having a predetermined width in a lengthwise direction of the insulation case 400, and a vertical flange 450 extending from one end of the horizontal flange 460 by a predefined length in a radial direction of the insulation case 400. The horizontal flange 460 may have an annular shape with a predetermined width and be attached onto the inner circumferential surface of the insulation case 400 by an adhesive agent. The vertical flange 450 may approximately vertically extend from one end of the horizontal flange 460 in the radial direction of the insulation case 400 so as to support the first stationary contact 100 and the like. The horizontal flange 460 may include a coupling groove portion 480 for coupling with another member using a coupling element such as a bolt or the like.

The gas insulated switchgear may generate fine particles due to metal components being crashed against each other during repetitive switching operation of the switchgear, and the fine particles are gradually accumulated within the insulation case 400 or scattered (dispersed). The metal particles may badly affect the insulation performance.

The horizontal flange 460 of the insulation case 400 may include a collection groove portion 470 for collecting therein the metal particles generated during the repetitive switching operation of the switchgear. The collection groove portion 470 may be in a shape of a recess with a predetermined width, and formed at the inner circumferential surface of the horizontal flange 460 in the circumferential direction. The collection groove portion 470 may be formed at the entire horizontal flange 460 in the circumferential direction. Alternatively, the collection groove portion 470 may be formed merely at a lower portion of the horizontal flange 460 in consideration of the fact that the generated metal particles having their own weights to some extent are moved downward due to gravity.

The collection groove portion 470 may be formed at a portion where the horizontal flange 460 and the vertical flange 450 contact each other. Here, it may be preferable that one surface of the vertical flange 450 defines one surface of the collection groove portion 470. With this configuration, the collection groove portion 470 can be less affected by flowing air by virtue of the vertical flange 450, and accordingly the metal particles collected and lay within the collection groove portion 470 can be effectively prevented from being scattered back to the outside.

Figure 4:
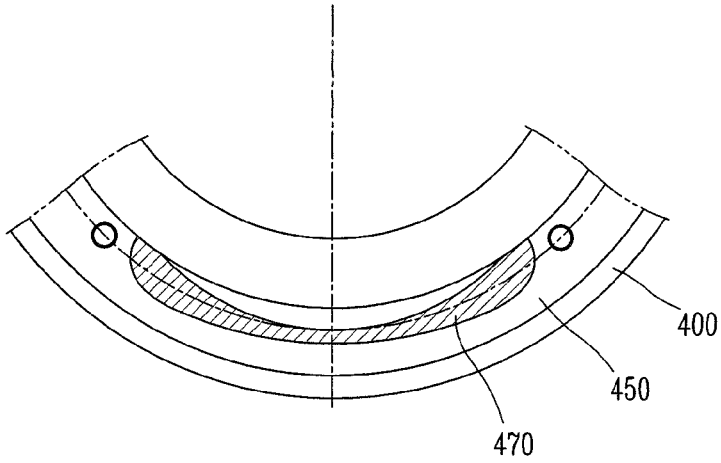
FIG. 4 is a partially enlarged view showing another embodiment of a collection groove portion formed at the insulation case of FIG. 3.

FIG. 4 shows another exemplary embodiment of the collection groove portion of the gas insulated switchgear. Regarding the configuration of a collection groove portion 470', a left-to-right width of the collection groove portion 470' is slightly increased as compared with FIG. 3. It may indicate that the size of the collection groove portion 470' including the left-to-right width thereof may depend on detailed configurations of products.

As described above, the predetermined space, referred to as the collection groove portion 470, 470' for collecting and lying metal particles therein can be provided at the flanges disposed at the inner circumferential surface of the insulation case in the gas insulated switchgear, thereby collecting the metal particles generated during operation of the breaking unit. Therefore, the metal particles cannot be stuck on an insulation member or other components of the insulation case, resulting in minimizing (or preventing) occurrence of insulation breakdown within the switchgear and improving reliability of a product.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A gas insulated switchgear comprising:

a stationary contact;

a moveable contact contactable with or uncontactable from the stationary contact;

an insulation case being sized to include the stationary contact and the moveable contact, wherein the insulation case is shaped to define a pipe, and wherein the insulation case is formed with electrically non-conductive material;

a flange positioned along an entire inner circumferential surface of the insulation case in a circumferential direction to form an annular shape, wherein the flange includes a horizontal portion formed with a width in a lengthwise direction of the insulation case, and a vertical portion extending from one end of the horizontal portion by a length in a radial direction of the insulation case, wherein the vertical portion includes an end that faces the radial direction and forms a surface configured to contact and support the stationary contact;

a collection groove portion formed at the flange and configured to collect metal particles generated during contact or separation operation between the stationary contact and the movable contact, wherein the collection groove portion is formed in the horizontal portion of the flange.

2. The switchgear of claim 1, wherein the collection groove portion is an annular groove located within the horizontal portion.

3. The switchgear of claim 1, wherein the collection groove portion is located at only a portion of the horizontal portion of the flange that is located at a lower side of the insulation case.

4. The switchgear of claim 2, wherein the collection groove portion is provided at a contact portion between the horizontal flange and the vertical flange, such that one surface of the vertical flange forms one surface of the collection groove portion.

5. The switchgear of claim 3, wherein the collection groove portion is provided at a contact portion between the horizontal flange and the vertical flange, such that one surface of the vertical flange forms one surface of the collection groove portion.

* * * * *